US009181488B2

(12) United States Patent
Marszal

(10) Patent No.: US 9,181,488 B2
(45) Date of Patent: Nov. 10, 2015

(54) WASTE MATERIAL CONVERTER USING ROTARY DRUM

(71) Applicant: Andrew Marszal, Windsor (CA)

(72) Inventor: Andrew Marszal, Windsor (CA)

( * ) Notice: Subject to any disclaimer, the term of this patent is extended or adjusted under 35 U.S.C. 154(b) by 309 days.

(21) Appl. No.: 13/803,069

(22) Filed: Mar. 14, 2013

(65) Prior Publication Data

US 2013/0256114 A1 Oct. 3, 2013

Related U.S. Application Data

(60) Provisional application No. 61/618,887, filed on Apr. 2, 2012.

(30) Foreign Application Priority Data

May 25, 2012 (CA) ..... 2777948
Jul. 13, 2012 (CA) ..... 2783082

(51) Int. Cl.

| | |
|---|---|
| ***C10B 1/10*** | (2006.01) |
| ***C10B 49/04*** | (2006.01) |
| ***C10B 21/20*** | (2006.01) |
| ***C10B 53/00*** | (2006.01) |
| ***F27B 7/36*** | (2006.01) |
| ***F27B 7/16*** | (2006.01) |
| ***F27B 7/20*** | (2006.01) |

(52) U.S. Cl.

CPC . *C10B 21/20* (2013.01); *C10B 1/10* (2013.01); *C10B 49/04* (2013.01); *C10B 53/00* (2013.01); *F27B 7/161* (2013.01); *F27B 7/20* (2013.01); *F27B 7/36* (2013.01)

(58) Field of Classification Search

CPC ..... C10B 49/04; C10B 49/06; C10B 1/10; C10B 53/00; C10B 21/20; F27B 7/20; F27B 7/36; F27B 7/161; F27B 7/362; F27B 2007/367; F23G 5/20

USPC ..... 202/100, 216, 85, 88, 91, 208, 218, 202/249; 110/246; 34/130, 138; 432/117, 432/105; 48/76, 89; 201/33

See application file for complete search history.

(56) References Cited

U.S. PATENT DOCUMENTS

| | | | | |
|---|---|---|---|---|
| 3,487,794 | A * | 1/1970 | Willey | 110/246 |
| 3,848,548 | A | 11/1974 | Bolejack, Jr. et al. | |
| 4,108,088 | A | 8/1978 | Burden, Jr. | |
| 4,266,931 | A | 5/1981 | Struckmann | |
| 4,351,251 | A | 9/1982 | Brashears | |
| 5,265,545 | A | 11/1993 | Milner | |

(Continued)

*Primary Examiner* — Jill Warden
*Assistant Examiner* — Joye L Woodard
(74) *Attorney, Agent, or Firm* — Young Basile Hanlon & MacFarlane P.C.

(57) ABSTRACT

An apparatus for controlled pyrolysis of waste material includes an elongate, perforated rotary drum lined with refractory material, having a longitudinal axis of rotation, and forming a chamber to receive and decompose the waste material. The drum includes a cylindrical metal exterior which has numerous apertures distributed over its cylindrical surface provided for passage of a limited amount of process air into the chamber. A mechanism is provided for supporting the drum for rotation about the longitudinal axis. An external shell encloses the rotary drum and prevents external ambient air from flowing through the apertures and into the chamber. Air distribution housings are distributed along the length of the rotary drum and form air distribution chambers each of which is enclosed except on an inner side of the chamber. This inner side is open for delivery of process air through a selected portion of apertures in the metal exterior.

9 Claims, 9 Drawing Sheets

(56) References Cited

U.S. PATENT DOCUMENTS

| | | | |
|---|---|---|---|
| 5,423,891 | A | 6/1995 | Taylor |
| 6,701,855 | B2 | 3/2004 | Barba |
| 2007/0245934 | A1 | 10/2007 | Carman |
| 2008/0006520 | A1 | 1/2008 | Badger et al. |

* cited by examiner

WASTE MATERIAL CONVERTER USING ROTARY DRUM

This application claims priority on U.S. Provisional Patent Application No. 61/618,887 filed Apr. 2, 2012, and Canadian Patent Applications Nos. 2,777,948 and 2,783,082 filed respectively on May 25, 2012 and Jul. 13, 2012.

BACKGROUND OF THE INVENTION

Field of the Invention

This invention relates to waste destruction systems and methods and, in particular, to converters for controlled pyrolysis of waste material to produce ash and non-toxic gases.

SUMMARY OF THE INVENTION

Burning of waste material in order to dispose of same is well known in the waste handling industry. An obvious advantage of burning waste is that it reduces the amount of waste that must be sent to landfill sites. However, there are also obvious disadvantages to the burning of waste material including the possible discharge of toxic substances and gases into the atmosphere as well as the discharge of carbon dioxide.

U.S. Pat. No. 4,266,931 issued May 12, 1981 to H. Struckmann teaches an apparatus and method for heating particulate material, the apparatus including a rotary combustion bed and a heat recuperator. The combustion bed is formed by a rotary drum having a longitudinal axis that extends horizontally and defining a chamber to receive and cascade particulate materials. The drum is formed by an outer shell, a perforated inner shell and a plurality of spacer plates secured to and between the two shells to define air distribution passages. A permeable refractory lining is disposed about the chamber of the drum and receives the cascading charge of material. A belt mechanism is provided to pass a flow of combustion air into selected air distribution passages to flow through the lining into the cascading charge in the chamber at a circumferential angle over a given angle of blow. The angle of blow can be adjusted.

Published US patent application 2008/0006520 teaches a system for converting carbonaceous feed stocks into useful sources of energy or chemicals. The feedstock is first dried in a dryer and then this feedstock is delivered to a reactor chamber. This system also includes a char separation and recovery mechanism linked to the reactor chamber for separating char. There are means for eliminating the amount of air entering the reactor chamber so as to provide oxygen depletion in the chamber.

Despite the existence of the aforementioned known waste combustion systems, there is need for an improved waste disposal system in the form of a converter which provides controlled pyrolysis of the waste material, which employs a perforated rotary drum that receives, cascades and combusts the waste material, and which is able to withstand the high temperatures required for pyrolysis over the working life of the system.

According to one aspect of the present disclosure, an apparatus for controlled pyrolysis of waste material includes a rotary drum arrangement including a rotatable drum having a cylindrical perforated wall lined with perforated refractory material, first and second drum ends, an inlet for the waste material and outlet means for end products of the pyrolysis process. The rotary drum has a central longitudinal axis of rotation and forms an interior chamber to receive, cascade and decompose waste material. The perforated wall has numerous apertures distributed over its surface for passage of process air into the interior chamber in order to permit controlled pyrolysis. A drive system is operably connected to the rotary drum in order to rotate same. A shell encloses the rotary drum arrangement and forms an outer sealed chamber extending about the rotatable drum. This shell is adapted to prevent external ambient air from flowing through the apertures and into the interior chamber. The apparatus further includes non-rotating air distribution housings mounted in the shell in the outer sealed chamber and distributed along the rotatable drum in the longitudinal direction. Each housing forms an air distribution chamber with an open inner side adjacent the cylindrical perforated wall of the drum. The housings are provided for delivery of process air through a selected portion of the apertures. An air delivery system is connected to the housings for delivering process air to the air distribution chambers.

In an exemplary embodiment of this apparatus, each air distribution chamber includes an air seal arrangement extending around a perimeter of the respective housing and acting to seal any gap between edges of the respective housing and an adjacent section of the cylindrical perforated wall.

According to another aspect of the present disclosure, a method for a controlled pyrolysis of waste material comprises mounting an elongated rotary drum in a sealed shell so as to form a sealed air gap extending about the rotary drum. The rotary drum has a cylindrical perforated wall able to withstand high temperatures produced by the controlled pyrolysis process and an interior chamber adapted to receive the waste material. The rotary drum is rotated about a central longitudinal axis of the drum and waste material is delivered to an inlet end of the interior chamber. The waste material is cascaded in and along the rotary drum. Controlled amounts of process air are delivered to selected separate exterior areas of the cylindrical perforated wall of the rotary drum. The exterior areas are distributed along the length of the rotary drum and the delivered process air passes through the perforated wall and up and into the waste material to allow controlled pyrolysis of the waste material in the interior chamber. End products produced by the controlled pyrolysis are removed from the rotary drum and the sealed shell.

In an exemplary form of this method, the elongate rotary drum has a metal exterior made of stainless steel or nickel-chromium alloy and a perforated refractory lining connected to the inner side of the metal exterior.

According to yet another embodiment of the present disclosure, an air distribution housing is provided for delivering air through apertures in a perforated exterior of a rotary drum used to process material at high, elevated temperatures. The housing includes a housing structure forming an air distribution chamber therein. The housing structure has a main wall adapted and constructed for extending over a selected area of the perforated exterior of the rotary drum and spaced therefrom and also peripheral walls connected to the main wall and extending about the periphery of the main wall and the air distribution chamber. An air seal system extends along at least one of the peripheral walls and comprises a metal seal enclosure rigidly connected to the at least one peripheral wall. The seal system includes a seal device movably mounted in the seal enclosure and extending lengthwise therein and a seal air delivery system capable of providing seal air to an air space formed in the seal enclosure in order to bias the seal device through an open radially inner side of the seal enclosure and towards the perforated exterior of the rotary drum.

In an exemplary version of this air distribution housing, the seal device is a seal pack made of synthetic material resistant to high temperatures in the order of 600° C.

These and other aspects of the disclosed apparatus and method of using the same will become more readily apparent to those having ordinary skill in the art from the following detailed description taken in conjunction with the drawings.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying photographs, the latter being briefly described hereinafter.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
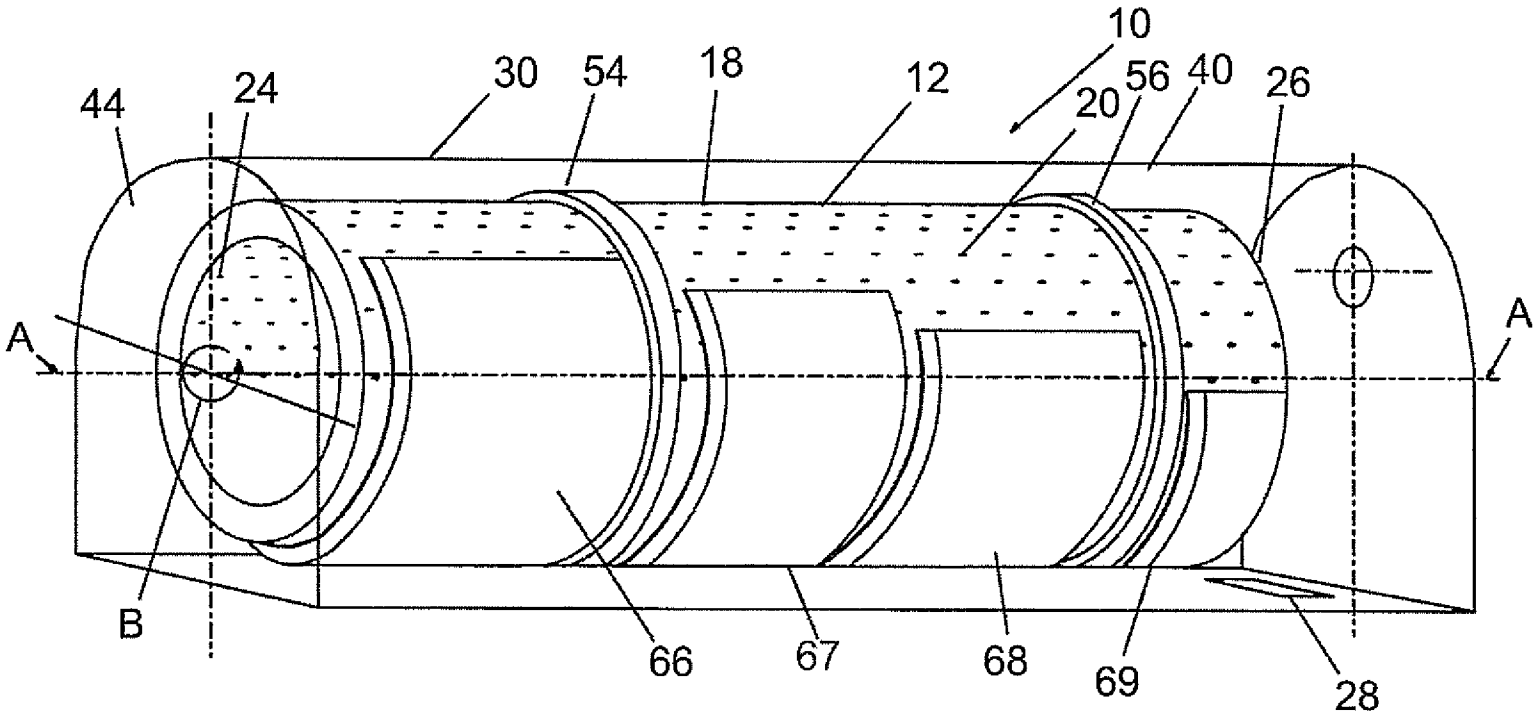
FIG. 1 is a schematic perspective view of a converter drum surrounded by an exterior shell which is shown as transparent for sake of illustration only.
Figure 2:
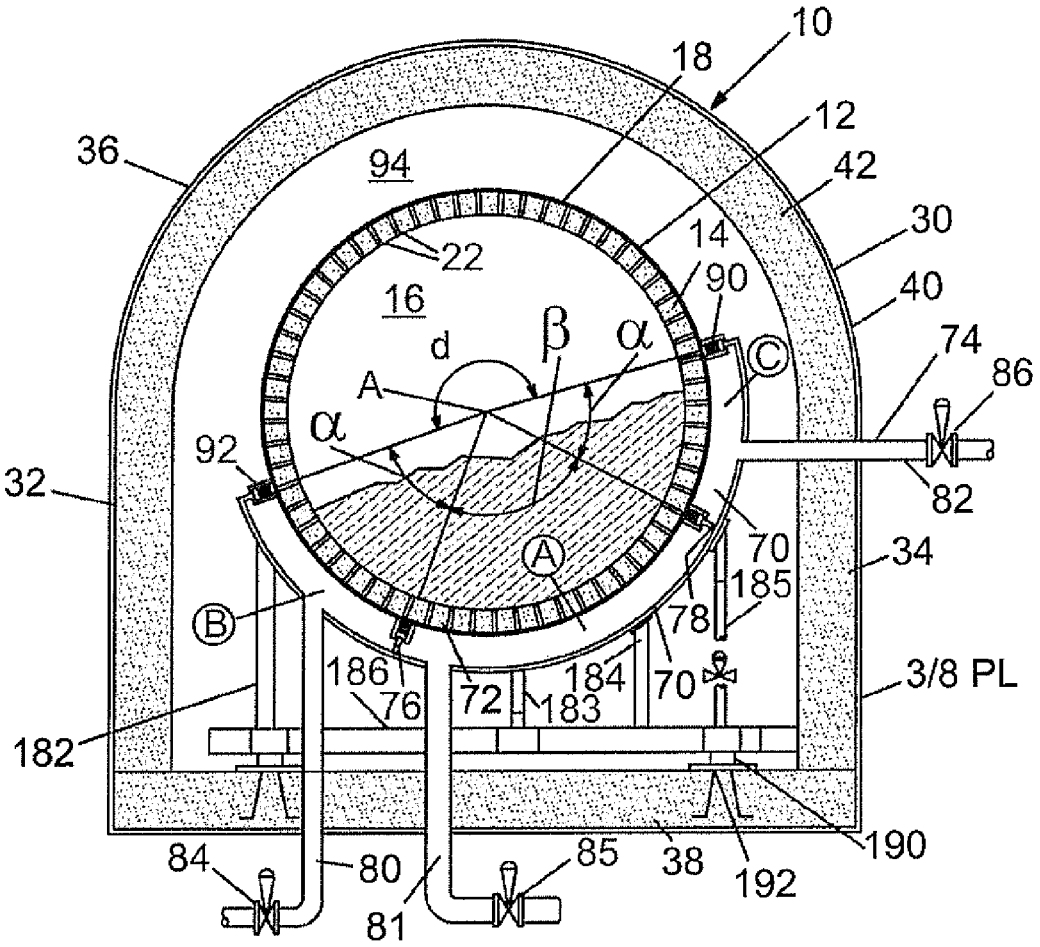
FIG. 2 is a transverse cross-section of the converter drum and shell of FIG. 1, this view also showing a framework for supporting an air distribution housing.

FIGS. 1 and 2 schematically illustrate an apparatus 10 for controlled pyrolysis of waste material. This apparatus including an elongate perforated rotary drum 12 lined with refractory material 14. The drum 12 has a longitudinal axis of rotation indicated at A which extends in a substantially horizontal direction. In order to encourage flow of material towards the outlet, it is also possible for the longitudinal axis to slope downwardly towards its outlet end (the right end as seen in FIG. 1) at angle of up to 16 degrees to horizontal. The drum forms a chamber 16 to receive, cascade and decompose waste material and the drum includes a cylindrical metal exterior 18. The metal exterior can be made of stainless steel or nickel-chromium alloy, materials which are able to withstand the elevated temperatures generated by the conversion process. The refractory material 14 forms an interior liner able to withstand the high temperatures in the rotating drum 12 during the conversion operation. The refractory lining can be a known material applied to and adhered to the sheet metal exterior. The refractory lining prevents the metal exterior from failing or distorting as a result of the high temperatures created by the conversion process. In order that the rotary drum can operate as intended for its desired working life, it must be constructed so that it will retain its proper cylindrical shape.

The metal exterior is perforated with numerous apertures 20 that are distributed over the cylindrical wall of the drum. The apertures 20 in the metal exterior are connected to short radial passages 22 formed in the refractory lining. In one embodiment of the sheet metal exterior of the drum, the thickness of the sheet metal is a minimum of 5/16th inch and it can be thicker. An exemplary metal alloy for the drum is nickel-chromium alloy, e.g. INCONEL (trade-mark). The drum has an inlet end at 24 and an outlet end at 26. The outlet end 26 can be entirely open, thereby allowing the escape of the gases created by the conversion process and the exit of residual ash from the drum. This ash is able to drop through a suitable bottom outlet 28 from which it can be taken and disposed of. As indicated schematically in FIG. 3, the inlet end is partly or substantially enclosed with an annular end wall that extends around the longitudinal axis A and has a central opening for the passage of waste material into the drum. The purpose of the apertures 20 in the drum is to allow process air to enter into the interior of the drum in a controlled manner as explained hereinafter. The size of the apertures 20 in the embodiment of FIG. 1 can vary and depend on such factors as the number of apertures formed in each unit area of the drum. In one embodiment of the rotary drum, each aperture has a diameter of about ¼ inch.

The apparatus 10 further includes an external shell 30 which is shown as transparent in FIG. 1 for illustration purposes only. The construction of the shell 30 can be seen from FIG. 2. The shell can include vertical, longitudinally extending side walls 32 and 34 and a semi cylindrical top section 36 as well as a bottom section 38 that extends horizontally. The shell acts to maintain the required elevated temperature of the rotary drum during the conversion process and also acts to prevent external ambient air from flowing through the apertures 20 in an uncontrolled manner and into the chamber 11. The shell 30 also has a metal exterior 40 formed of suitable heat resistant steel plate and a refractory liner 42 which helps protect the metal exterior of the shell. The liner can be a known composite aggregate able to adhere to the metal exterior. Alternatively the refractory material can be joined to the metal exterior 40 by wire anchors tack welded to the steel exterior. All walls of the shell including the bottom are lined with the refractory material as illustrated in FIG. 2. The metal exterior of the shell can be made of carbon steel since it is not exposed to the same high temperatures as the drum. The shell includes an inlet end wall 44 which can be formed with a centrally located opening 46 for passage of waste material into the shell and into the interior of the drum (see FIG. 3). The shell also has an opposite end wall 48 which can be formed with an outlet 50 for passage of gases produced by the conversion process. These gases can be fed to gas cleaners or scrubbers or to cyclone equipment in order to remove undesirable material such as dust from the gas before it is released into the atmosphere. Gas cleaning equipment of this type is well known in the pollution control industry and accordingly a detailed description herein is deemed unnecessary. The two end walls of the shell are also refractory aligned. Like the drum inside, the shell 30 can also be made to slope downwardly towards the end wall 48. For example, the shell can slope at the same angle to horizontal as the drum inside it. The shell 30 and its contents can be supported on the ground on a suitable support structure capable of withstanding the substantial weight of the shell and the drum. This support structure can include two or more saddles or support plates 52 which can be part of a support framework to support the apparatus 10 in an elevated position above the ground.

Figure 3:
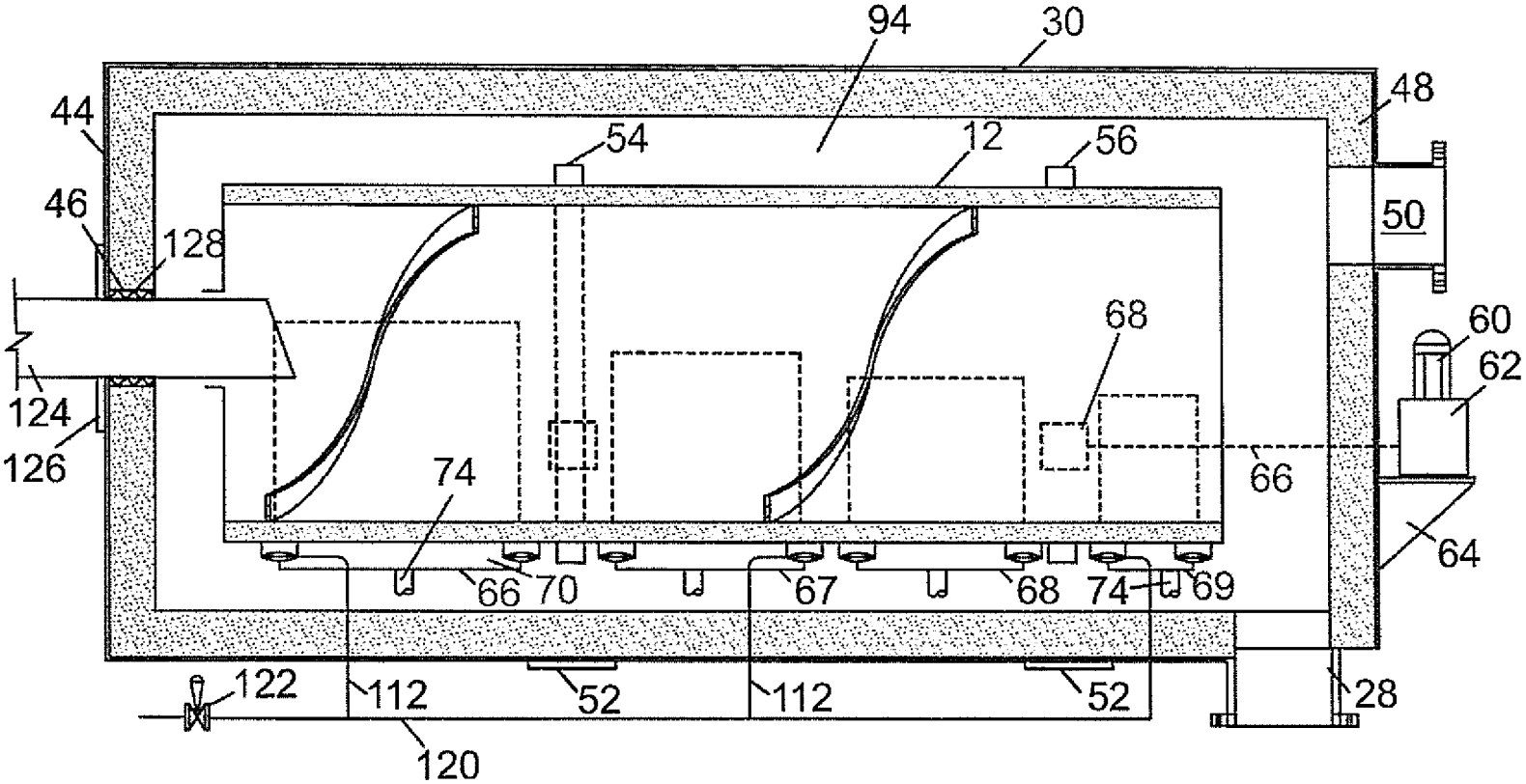
FIG. 3 is a longitudinal cross-section of a converter drum and surrounding shell and also illustrates a drive system for rotating the drum.

The drum 12 is rotatably supported in the shell 30. The mechanism for rotatably supporting the drum can include two or more bearing rings 54, 56 that extend about its cylindrical exterior. Although only two such rings are illustrated in FIGS. 1 and 3, it will be understood that a sufficient number of rings are provided to support the weight of the drum and to prevent distortion of the drum during its operation. The bearing rings are supported from below by suitably mounted rollers that are able to withstand the high temperatures within the shell. The bearing rings 54, 56 can be made of the same material as the drum 12 and they can be hollow rings in order to reduce weight and cost. The diameter of the drum is preferably limited so as to permit transport of same over roads and highways at a reasonable cost. An exemplary embodiment of the drum has a diameter of between 5 and 6 feet which enables it to be transported along many roads.

The apparatus 10 also includes a drive system operably connected to the rotary drum and adapted to rotate this drum. An exemplary drive system is illustrated schematically in FIG. 3 and includes electric drive motor 60, the output of which can be connected to a suitable gear box 62. The motor and gear box can be mounted on a support bracket 64 which can be mounted on the end wall 48 of the shell. A drive shaft 66 (indicated in dash lines only) extends from the gear box to one or more drive rollers 68 which rollably engage one or more of the bearing rings 54, 56. The size of the drive shaft can vary and depends upon the size and weight of the drum 12. One exemplary version of the shaft is tubular in order to reduce weight and is made of stainless steel so that it is able to withstand high temperatures. The passage in the end wall 48 through which the drive shaft extends is suitably sealed about its perimeter to prevent outside air from entering into the shell at this location. The output of the electric motor 60 can vary depending upon the size of the drum and other parameters such as rotation speed. In one embodiment, the motor used is a 20 horsepower motor. The motor is mounted outside of the shell so that it is not subject to high temperature conditions.

A significant feature of the conversion apparatus 10 is the provision of a plurality of rigid air distributing housings indicated at 66-69 at in FIG. 1. These housings can be distributed along the length of the rotary drum 12 and they form air distribution chambers indicating generally by reference 70. Each of these chambers is enclosed except on an inner side of the chamber indicated at 72. This inner side faces and is adjacent to the rotary drum 12. The inner side of each chamber is open for delivery of process air through a selected portion of the apertures 20 in the metal exterior of the drum. A pipe distribution system indicated generally at 74 is provided to deliver the process air to the air distribution chambers.

As illustrated in FIG. 2, each air distributing housing can be internally divided by interior walls 76, 78. Although two interior walls are shown in FIG. 2, in some versions there may be only one such interior wall or more than two. These interior walls extend lengthwise in the direction of the longitudinal axis A and they separate the internal air distribution chamber formed by the overall housing into smaller air distribution chambers or sub-chambers, such as the indicated chambers A, B, and C with the chamber A being a larger, centrally located chamber bounded on two opposite sides by the chambers B and C. It will be seen that the chamber B extends through angle $\alpha$ which is centered on the axis A while the central chamber A extends through the angle $\beta$. As illustrated, the chamber C is of substantially the same size as the chamber B and subtends an angle $\alpha$. By subdividing the air distribution chamber formed by the housing in this manner, the amount of process air delivered through to the apertures can be varied for proper control of the conversion process. In particular the process air delivered through the chamber B can be a moderate amount (in other words, moderate blow through) created by a medium level of air pressure while, on the other hand, the amount of process air delivered through the apertures from the chamber A can be substantial due to intensive blow or high air pressure in the chamber. It will be understood that a greater level of blow for the process air through the angle $\beta$ is desirable in view of the large amount of waste material in this region e.g. a thicker layer of material as shown. The amount of process air delivered from the chamber C can be a moderate amount created by a medium level of air being blown through the adjacent apertures. There is no air blown through the apertures located on the drum in the region of the angle d. The aforementioned pipe distribution system 74 can include separate delivery pipe sections 80, 81, 82 connected to each of the air distribution housings. Thus the pipe section 80 can deliver process air to chamber B, pipe section 81 can deliver process air to chamber A and pipe section 82 can deliver process air to chamber C.

As shown in FIGS. 1-3, each air distributing housing can vary in size of drum area covered from the inlet end 24 of the drum to the outlet end. The size of housing depends upon the particular process perimeters. As shown, the housing 66 closest to the inlet end is the largest and the housings become progressively smaller in the circumferential direction towards the outlet end (or furthest from the inlet end) with the smallest housing 69 being at the outlet end. Each of these air distribution housings 66-69 extends through an arc in the direction of rotation of the drum, this direction being indicated by the arrow B in FIG. 1. Due to the tendency of the waste material to follow the direction of rotation of the drum, each of the air distribution sections extends above the horizontal plane extending through the longitudinal axis A on the side of the drum to which of the lower half of the drum is rotating. Correspondingly, the opposite side wall of the housing can be located below this horizontal plane extending through the axis A as clearly shown in FIG. 2. Each air distribution housing subtends an angle centered on the longitudinal axis A which, in a case of the housing shown in FIG. 2 is equal to angle $\alpha$+angle $\beta$+ angle $\alpha$.

FIG. 2 illustrates how each of the air distribution housings can be supported by means of stainless steel upright posts 182-185 which vary in length to accommodate the curvature of the exterior of their respective housing. The posts can be mounted on a horizontal framework 186 which is secured to the bottom section 38 of the shell. The number of posts should be sufficient to support the weight of their respective housing which can be 6 feet wide or more.

The air distribution housings 66 to 69 which can be made of stainless steel sheet must be constructed so that they can withstand the internal air pressure used to provide the process air without deformation of the housing. If necessary, for this purpose, the walls of the housing can be formed with an integral external rib system to strength the walls. These reinforcing ribs are not shown in the drawings For ease of installation and for easy removal, the stainless steel horizontal frame work 186 that supports the air distribution housing can be mounted on rollers 190 shown schematically in FIG. 2. These rollers can rotatably engage flat horizontal stainless steel tracks 192 supported in the top surface of the bottom section of the shell. These tracks can be made from 8 inch wide flat bar having a thickness of 1½ inch. The tracks 192 can be provided longitudinally extending side rails along their opposite edges, if desired.

Valves are provided for adjusting the amount of process air delivered to each air distribution chamber 70 and the sub chambers formed therein. Three such valves are shown at 84-86 in FIG. 2 and it will be understood that there can be three of these valves (or more) for each of the air distribution housings 66-69. The valves are adjusted so that the amount of process air delivered to the distribution chambers permits the conversion process to be maintained at a temperature ranging from 450° C. to 600° C. or more. In the exemplary embodiment of the apparatus 10, the process air control valves allow programmable logistic control operation controlled by a PLC (programmable logistic control system), if desired. The valves 84-86 can also be manually controlled by operators of the apparatus, particularly at the commencement of the conversion process. It will be appreciated that the amount of the process air to be blown into the drum depends on at least several different parameters including the speed of rotation of the drum, the nature of the waste feedstock and the current measured temperature inside the drum.

Figure 4:
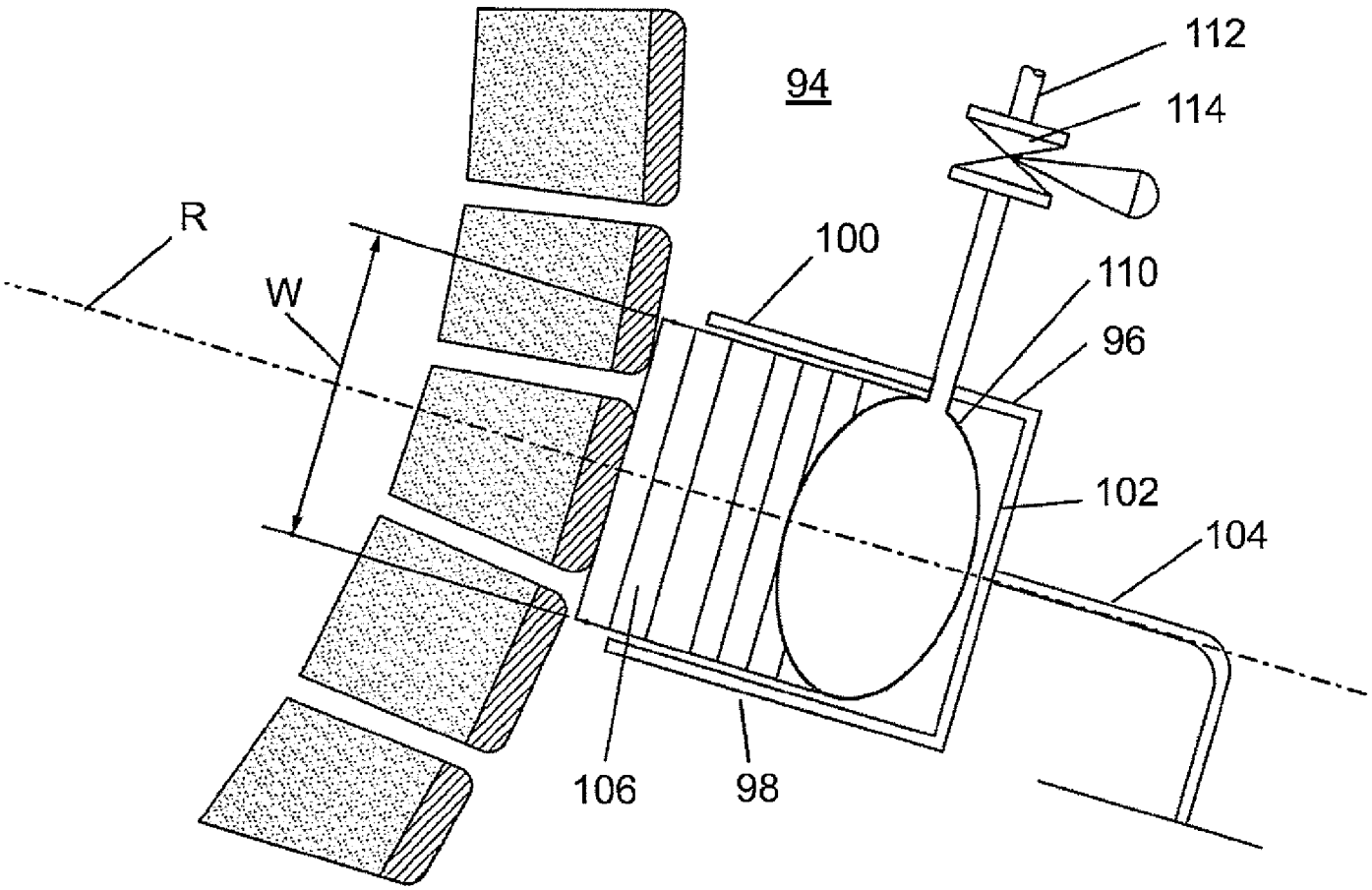
FIG. 4 is a cross-sectional detail taken in a vertical plane transverse to the longitudinal axis of the converter drum, this view illustrating an air seal extending along the perimeter of each air distribution housing.

Extending around the perimeter of each of the air distribution housings is an air seal system indicated generally at 90. Details of an exemplary embodiment of the air seal which extends along each side of each air distributing housing can be seen in FIG. 4. In addition an air seal can be provided along the radially inner edge of each interior wall 76, 78 as shown in FIG. 2. These air seals prevent process air from passing into the gap or surrounding space 94 locating between the rotating drum 12 and the shell 30. In the case of the air seals provided on the interior walls, these seals prevent process air from passing between the sub chambers A, B, and C formed in each air distributing housing.

Each section of the air seal is surrounded by a steel enclosure 96. These enclosures can be made of the same metal as the air distribution housing on which it is mounted. The exemplary illustrated enclosure 96 includes spaced apart inner and outer wall sections 98, 100 and a connecting wall section 102 that can be welded at its center to side wall 104 of the housing. The illustrated seal includes a seal pack 106 which per se can be of known construction. For example, the seal pack can be made from synthetic fabric resistant to high temperatures. In one embodiment of this seal pack, the depth of the seal extending in the direction of the radius R is about 2 inches while the width of a seal is about 4 inches. This width is indicated by the dimension w. The seal pack should be selected so that it is capable of resisting temperatures in the order of 600° C. Pressing on the seal pack is an inflatable, flexible tubing 110 also made of synthetic material capable of withstanding temperatures of up to 600° C. The tubing can be made of flexible, synthetic, impermeable material which is heat resistant or it can be made of corrugated, stainless steel foil. The amount by which the tubing 110 is inflated is regulated by seal air that can be delivered through air tubing 112. Flow of seal air through this tubing or pipe can be controlled by means of a valve 114 which can be a solenoid valve that is electrically controlled by computer. A suitable air pressure for the air seals is between 100 and 150 bar. Each of the air pressure control valves 114 and the valves that control the flow of process air is mounted outside of the shell 30 so that the valve does not have to withstand the high temperatures within the shell and can be readily maintained (and replaced if necessary). Although the air pressure in each of the air seals can, in many cases be maintained at the same pressure throughout the air seal system, it is also possible to vary the air seal pressure depending upon particular seal requirements. For example, the required air pressure for air seals extending along internal walls 76, 78 may vary from that required for the air seals extending about the perimeter of the distributing housing. The air seals are replaced from time to time, as required and as they become worn. A life span of one year for an air seal may be possible under certain operating conditions in view of the fact that the drum rotates relatively slowly which helps reduce the amount of wear on the seal.

The exemplary metal used for the enclosure 96 is stainless steel which is more resistant to the high temperatures inside the shell. It will be understood that the air seal system as described, in addition to sealing the gap between the side walls of the air distributing housings and the drum also allows for small imperfections in the cylindrical exterior surface of the drum and allows for slight deformation of the drum from continuing operations.

FIG. 3 illustrates schematically an exterior air pipe 120 that can be used to deliver seal air to the air seal system. The pipe 120 is connected to a source of pressurized air (not shown). The aforementioned air tubing 112 can be connected to this air pipe. A main air valve 122 can be mounted in the pipe 120 which is able to control all of the flow of pressurized air to the air seal system.

FIG. 3 also illustrates a delivery pipe 124 for delivery of waste feedstock to the interior of the drum 12. This delivery pipe extends through a suitably sized opening in the end wall 44. A mounting plate 126 can be affixed to the exterior of the end wall to support the delivery pipe. Suitable heat resistant insulation can be provided around the delivery pipe at 128. A spiral screw (not shown) can be rotatably mounted in the delivery pipe for feeding waste material into the drum and also for limiting the entry of air through the pipe into the drum. The delivery pipe and the internal spiral screw can be made of a nickel-chromium alloy in order to withstand the surrounding high temperature conditions. In an exemplary version of the waste material delivery system, the waste material is compacted or otherwise processed so that little or no air is delivered with the waste material through the delivery pipe 124. Compaction systems for waste material are well known in the waste handling art and need not be described herein.

Figure 5:
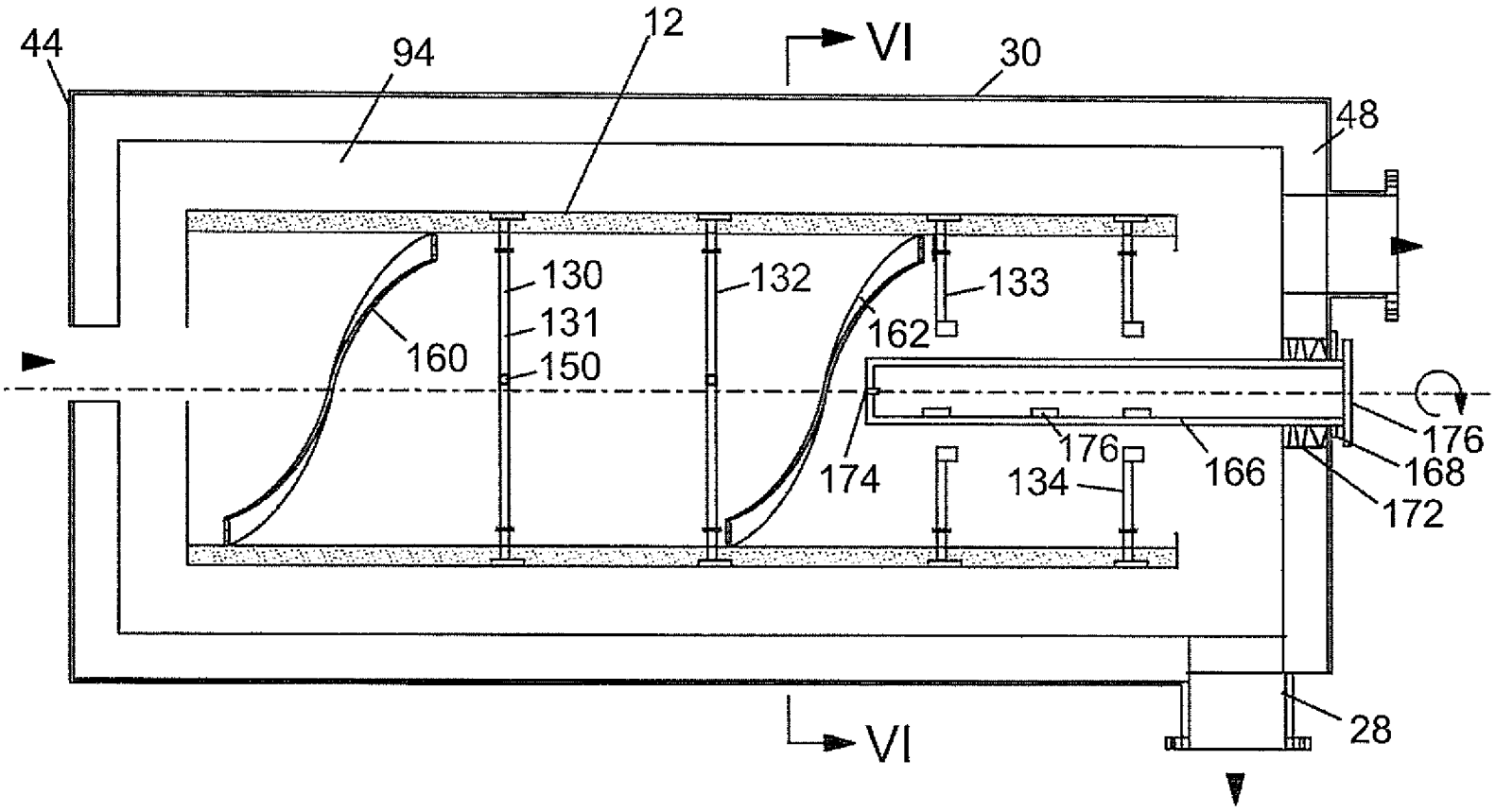
FIG. 5 is a longitudinal cross-section taken along the line V-V of FIG. 6, this view illustrating an embodiment having a central, longitudinal tube extending partway along the central axis of the rotating drum.

FIG. 5 illustrates additional exemplary features that can be incorporated into an apparatus for controlled pyrolysis constructed in accordance with the invention. Certain features have been omitted from FIG. 5 for ease of illustration including the support for the rotary drum 12 and the air distribution housings. In particular, the drum can be strengthened or reinforced internally to increase structural stiffness by means of a structural spacer system indicated generally at 130 and shown in more detail in FIGS. 6-9. As illustrated in FIG. 5, there are four spaced apart structural spacers 131-134 with spacers 131 and 132 being substantially identical to one another and spacers 133 and 134 being substantially identical to one another. Although four structural spacers are shown, it will be appreciated that there can be fewer of these or more, depending upon the size of the drum and support requirements. The structural spacers can also be made from a nickel-chromium alloy able to withstand the high temperatures in the drum. Each structural spacer comprises a plurality of radially extending spokes, each of which has an outer end connected to the circumferential drum wall. The structural spacer 133 shown from the front side in FIG. 6 has four radial spokes 140-143 but it will be understood that there can be fewer spokes in each spacer or more, for example, six spokes distributed evenly about the longitudinal axis A. The spokes of the spacers 131 and 132 can be connected at a central hub 150, which can comprise a solid nickel chromium disk. It will be understood that there should be sufficient space between the spokes to allow for the free flow of the waste material through the spaces between the spokes.

Figure 7:
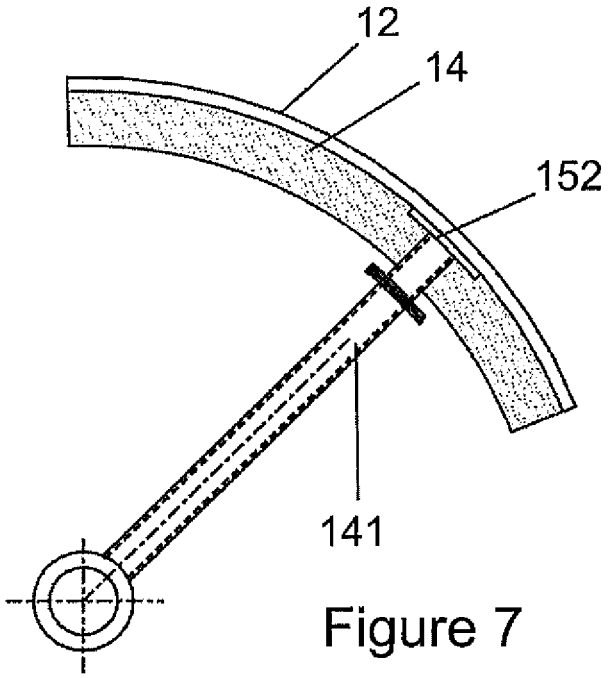
FIG. 7 is a sectional detail view of a support frame for the rotating drum, this view being taken in the circle VII of FIG. 6.

The manner in which each spoke is connected to the drum wall is illustrated in FIG. 7. Flat splice plates 152 can be provided on the inner side surface of the metal exterior of the drum at the points of attachment of the spokes. Each spoke is preferably in the form of a tubular member made of nickel-chromium alloy.

Figure 8:
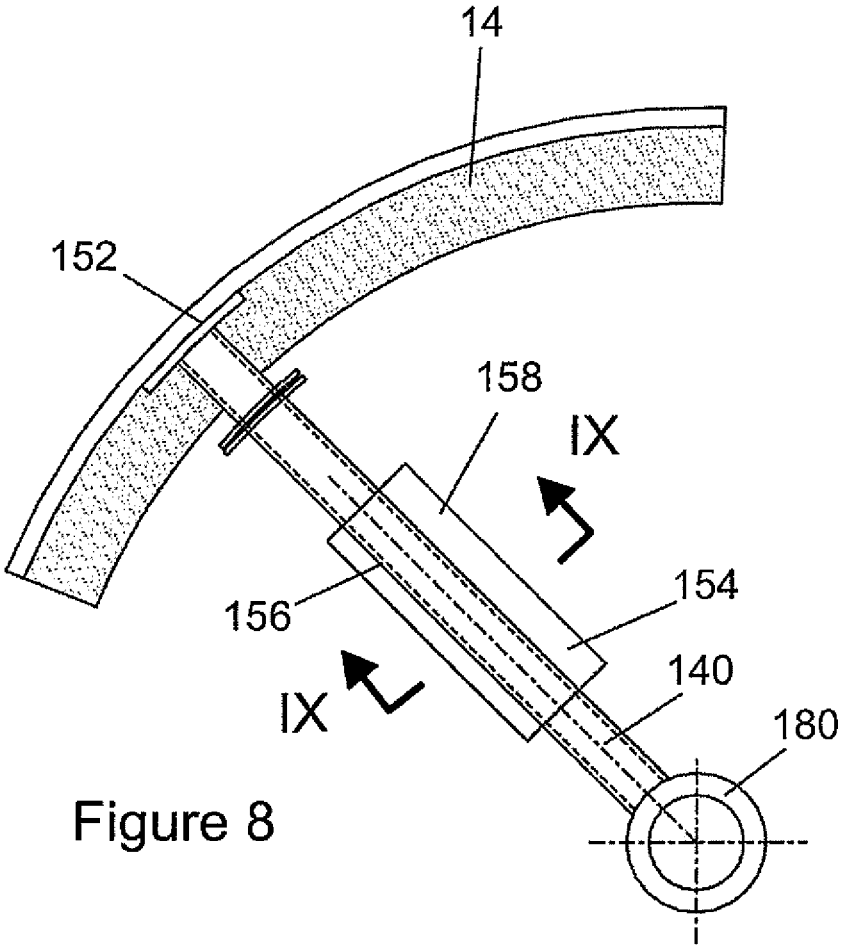
FIG. 8 is another sectional detail similar to FIG. 7 but showing an alternate form of support frame construction for the drum.
Figure 9:
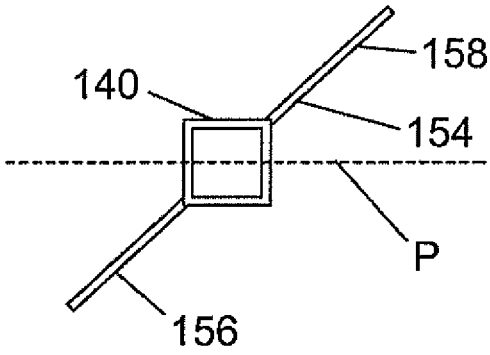
FIG. 9 is a cross-sectional detail of the support frame of FIG. 8, this view being taken along the line IX-IX of FIG. 8.

If desired, each spoke can be constructed with a blade as illustrated in FIGS. 8 and 9 to help feed the waste material towards the outlet end. This blade 154 can comprise two half blades 156, 158 that extend outwardly from opposite sides of their respective spoke such as the spoke 140 illustrated in FIGS. 8 and 9. It will be understood that each blade is angled relative to a transverse plane extending perpendicular to the longitudinal axis A in a manner which will tend to drive the waste material towards the outlet end of the drum. For example, this transverse plane is indicated at P in FIG. 9 and the angle of slope of the blade is shown as 45° to the plane P.

Figure 6:
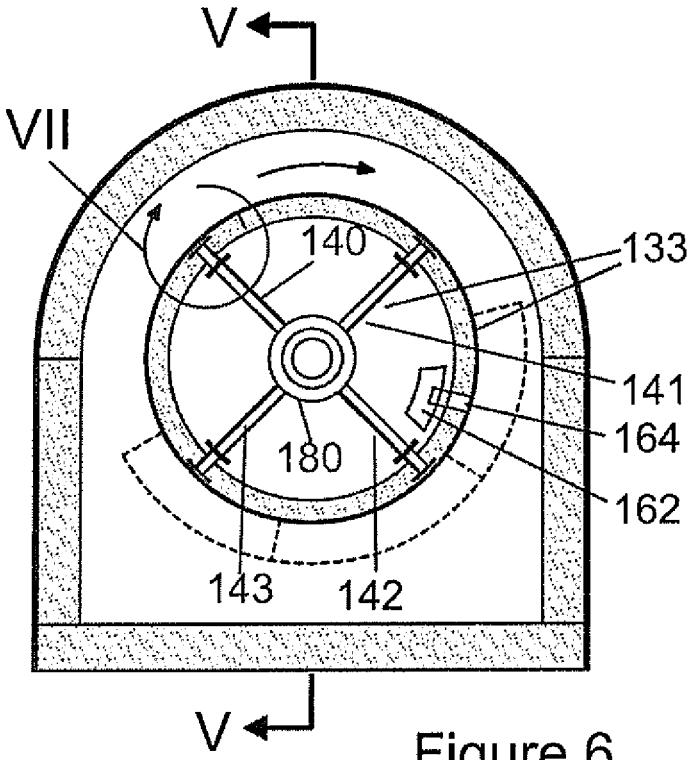
FIG. 6 is a transverse cross-section of the rotating drum and shell of FIG. 5, this view being taken along the line VI-VI of FIG. 5.

Further spiral blades are provided for feeding the waste material towards the outlet end of the drum. Two such spiral blades are illustrated in FIG. 5 at 160 and 162. Although these blades are shown only on one semi-cylindrical side of the drum in FIG. 5, it will be appreciated that in an exemplary version of the drum, these blades form a substantially continuous spiral around the interior of the drum from the inlet end to the outlet end in order that they may continuously drive the material towards the outlet end. The spiral blades are made from nickel-chromium alloy in an exemplary version of the drum. A short section of the blade 162 is illustrated in FIG. 6 which also shows how the blade is attached to the metal exterior of the drum. In particular, nickel-chromium attachment pins 164 can be used for this purpose. The outer end of each pin is preferably welded to a reinforcement plate similar to the reinforcement plate 152 shown in FIG. 7. In an exemplary version of the drum, each spiral blade 160, 162 is rigidly connected at one end but is slidably connected at an opposite end in order to allow for thermal expansion as the drum heats up for the conversion process.

Another desirable feature of the conversion apparatus illustrated in FIG. 5 is an instrument holding pipe member 166 which extends though the center of the structural spacers 133, 134 as shown. The pipe member extends axially inwardly from the lined end wall 48 and it can be mounted on this end wall by means of reinforcing plate 168 secured to the metal exterior of the end wall. A connecting flange 170 at the outer end of the pipe member can be attached to the plate 168, by for example, threaded fasteners (not shown). Suitable heat resistant insulation 172 can extend around the pipe member where it extends through the end wall. One or more cameras 174 can be mounted at or adjacent the inner end of the pipe member and can be used to view the ongoing process inside the rotary drum. There can also be mounted along the length of the pipe member temperature measuring thermocouples 176 which are used to monitor the temperatures within the drum. In addition, optional means can be provided for cooling the interior of the pipe member so that the integrity of the pipe member and the measuring instruments or cameras arranged on or within it can be maintained. It is also possible to provide means for rotating the pipe member 166 about its center axis in order to obtain more views or more measurements.

As shown in FIGS. 6 and 8, the spokes that form the structural spacers 133, 134 can be connected at their inner ends to a respective nickel-chromium alloy ring 180. This ring preferably has an internal diameter corresponding closely to the external diameter of the pipe member 166. The two or more rings 180 help support the inwardly projecting portion of the pipe member, while still allowing relative rotation between the drum and the pipe member.

As indicated the thickness of the metal exterior of the drum can vary from 5/16th inch to a greater thickness with the thickness depending to some extent on the structural support provided for the drum including the structural supports on its interior. The refractory material on the inside of the drum can be 3 inches to 4 inches thick and this material is capable of reducing the temperature from an internal surface temperature of 1100° C. (which will support the conversion process) to about 600° C. on the outside of the drum. The refractory lining on the shell 30 is adapted to withstand a range of temperatures extending from about 600° C. on the inside surface of the shell to the ambient outside temperature which can be as low as 0° C. or lower.

The bearing rings that extend about the exterior of the drum can be hollow bent channels as illustrated in FIG. 1 or they can be bent tubing made of nickel-chromium alloy. The driving and idler rollers that engage the bearing rings are selected so that they are capable of withstanding the high temperatures within the shell. Both the idler and the drive rollers that support and rotate the drum can be mounted above the floor section of the shell by means of stainless steel, tubular posts, for example 5.5 inch tubing.

The conversion apparatus 10 can be manufactured as two main sections in a manufacturing facility for delivery by truck or rail to the plant site. The shell 30 can be one of these sections and can weigh on the order of 85 tons with the refractory lining installed. The rotary drum can be the other main component shipped separately to the plant site and fitted with the required components including the air distributing housings, the rotary drive system and the air piping. If maintenance should be required after initial operation of the conversion apparatus, the apparatus can be disassembled relatively quickly and easily and the drum for example can be removed by means of an overhead bridge system.

It is also possible to shop fabricate smaller pieces and components of the converter and deliver these to the operation site. These pieces can be assembled by bolting them together on the site and then the pieces can be seal welded along all splices or assembly joints.

Furthermore the whole internal system of the converter, including the drum, both air delivery systems, piping, and rollers for the drum, can be fabricated as a skid unit that can easily be removed for maintenance or replacement.

Figure 10:
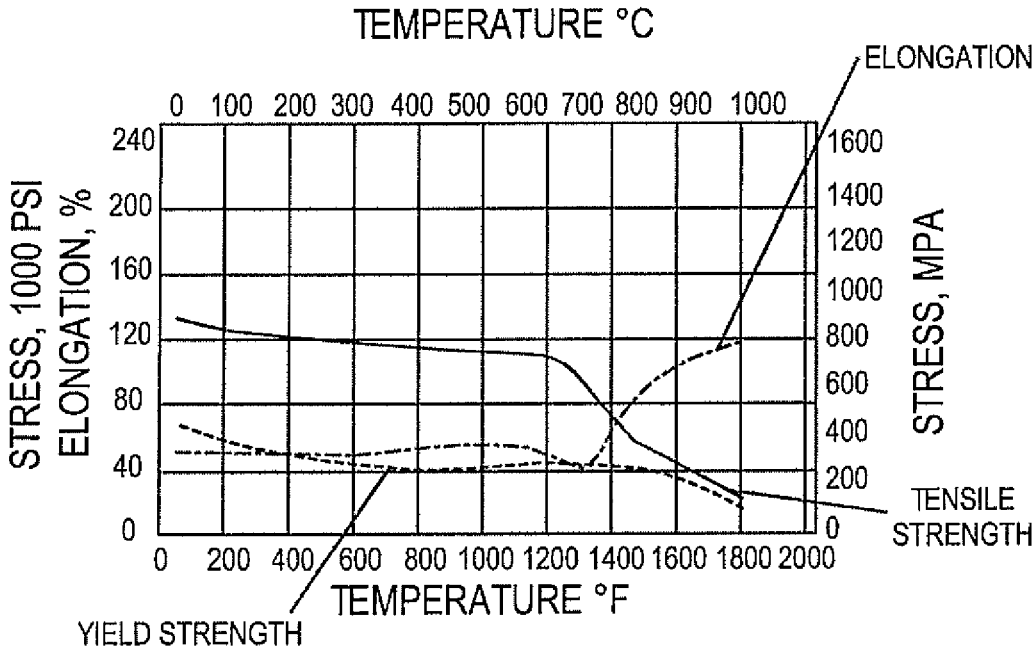
FIG. 10 is a graph of Stress and Elongation of INCONEL alloy 625 vs. temperature in degrees F. and C.

FIG. 10 is a graph of stress versus temperature (both Celsius and Fahrenheit) for an exemplary nickel-chromium-molybdenum alloy that can be used for the exterior of the drum 12. This alloy is sold under the trade-mark INCONEL as alloy 625. The alloy provides high strength without a strengthening heat treatment and resists a wide range of severely corrosive environments. It has a rupture strength (1000 h) at 650° C. of 52,000 psi and a rupture strength at 760° C. of 23,000 psi. Its melting range is 1290-1350° C. The alloy contains a minimum of 58% nickel and 20-23% chromium. Its molybdenum content is between 8 and 10%.

Figure 11:
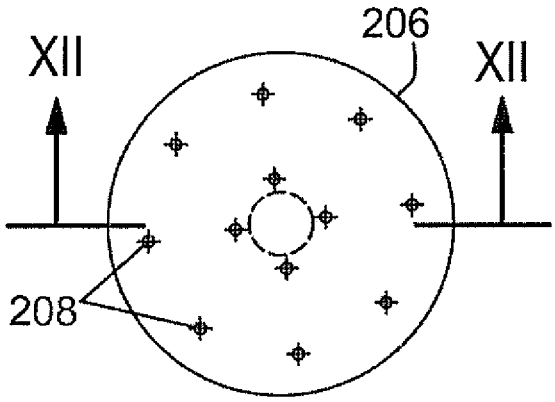
FIG. 11 is a top or inside view of an air distribution manifold that can be mounted on the inner surface of the refractory lining in the drum.
Figure 12:
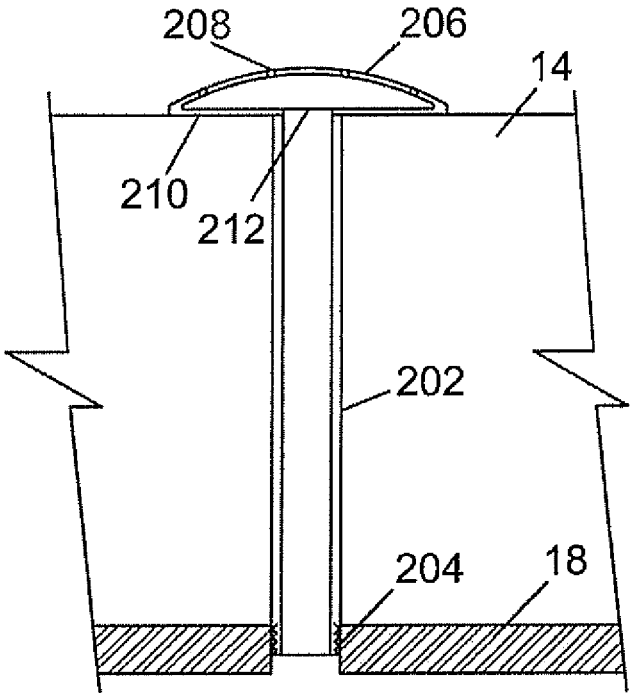
FIG. 12 is a cross-sectional view taken along the line XII-XII of FIG. 11, this view showing the manifold and attached air pipe.

FIGS. 11 and 12 illustrate an exemplary method for delivering process air to the interior of the drum 12. This construction reduces the number of apertures that need to be formed in the exterior metal shell of the drum and the number of passageways through the refractory lining. Extending inwardly from each aperture formed in the metal exterior is a short pipe or tube 202 which can be made of nickel-chromium alloy such as the exemplary INCONEL alloy described above. The other end of the pipe can be attached by threads at 204 to the metal exterior 18 of the drum. Mounted on the inner end of the pipe is an air manifold 206, a top view of which is shown in FIG. 11. The manifold is formed in its top surface with a number of small apertures 208 for the delivery of process air to the interior of the drum. As shown in FIG. 12, the top of the manifold is rounded so as to have a convex exterior surface. A bottom section 210 of the manifold is flat and can rest against the exposed inner surface of the refractory lining as shown. The bottom section has a central opening at 212 which is where the pipe 202 is connected.

It will be appreciated that with the use of these manifolds, there can be a plurality of apertures 208 for the distribution of the process air which are fed by a single, short pipe 202. The manifold portion is also made from nickel-chromium alloy.

Instead of a computer, a programmable logic controller can be used to control every aspect of the operation of the conversion apparatus including process air supply, seal air supply, the rotary drive system and the control instruments such as the internal cameras and temperature measuring devices.

Although the present invention has been illustrated and described as embodied in exemplary embodiments, e.g. an apparatus and a method for controlled pyrolysis of waste material, it is to be understood that the present invention is not limited to the details shown herein, since it will be understood that various omissions, modifications, substitutions and changes in the forms and details of the disclosed apparatus and method and/or operation may be made by those still in the art without departing in any way from the scope of the present invention. For example, those of ordinary skill in the art will readily adapt the present disclosure for various other applications without departing from the scope of the present invention.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. Apparatus for controlled pyrolysis of waste material comprising:

a rotary drum arrangement including a rotatable drum having a cylindrical perforated wall lined with perforated refractory material, first and second drum ends, an inlet for said waste material, and outlet means for end products of the pyrolysis process, said rotary drum having a central, longitudinal axis of rotation and forming an interior chamber to receive, cascade and decompose waste material, said perforated wall having numerous apertures distributed over its surface for passage of process air into said interior chamber;

a drive system operably connected to said rotatable drum in order to rotate same;

a shell enclosing said rotary drum arrangement and forming an outer sealed chamber extending about said rotatable drum, said shell adapted to prevent external ambient air from flowing through said apertures and into the interior chamber;

non-rotatable air distribution housings mounted in said shell in said outer sealed chamber and distributed along said rotatable drum in the longitudinal direction, each housing forming an air distribution chamber with an open inner side adjacent the cylindrical perforated wall of the drum, said housings being provided for delivery of process air through selected portions of the apertures; and an air delivery system connected to said housings for delivery of said process air to the air distribution chambers.

2. Apparatus for controlled pyrolysis according to claim 1 wherein each air distribution housing includes an air seal arrangement extending around a perimeter of the respective housing and acting to seal any gap between edges of the respective housing and an adjacent section of the cylindrical perforated wall.

3. Apparatus for controlled pyrolysis according to claim 1 wherein said air delivery system includes air delivery pipes connected to said housings and valve means for adjusting the amount of process air delivered through said pipes to said air distribution chambers.

4. Apparatus for controlled pyrolysis according to claim 1 wherein said central longitudinal axis slopes downwardly at an acute angle to horizontal towards the second end of the rotatable drum and said outlet means.

5. Apparatus for controlled pyrolysis according to claim 1 wherein said rotatable drum has a metal exterior made of stainless steel or nickel-chromium alloy and able to withstand high temperatures produced by the controlled pyrolysis.

6. Apparatus for controlled pyrolysis according to claim 1 wherein said first end of the rotatable drum is partially covered and forms said inlet for delivery of said waste material into said interior chamber and said second end is spaced from an adjacent end of the shell, and wherein said apparatus includes a delivery system extending through an opposite end of the shell and adapted for delivery of waste feedstock through said inlet end of the drum and into said interior chamber.

7. Apparatus for controlled pyrolysis according to claim 1 wherein one or more of said air distribution housings has mounted therein at least one interior wall extending parallel to said central, longitudinal axis and dividing its respective air distribution chamber into sub-chambers.

8. Apparatus for controlled pyrolysis according to claim 2 wherein said air distribution housings vary in size of drum area covered relative to one another.

9. Apparatus for controlled pyrolysis according to claim 8 wherein the drum area covered by each distribution housing decreases from the distribution housing closest to said first end of the drum to the distribution housing closest to said second end of the drum.

* * * * *